United States Patent [19]

Hart et al.

[11] 4,115,769

[45] Sep. 19, 1978

[54] DAMPING MEANS FOR INDICATORS

[75] Inventors: Robert D. Hart, Collinsville; Robert Mazzamauro, Waterbury, both of Conn.

[73] Assignee: General Time Corporation, Thomaston, Conn.

[21] Appl. No.: 802,937

[22] Filed: Jun. 2, 1977

[51] Int. Cl.[2] ..... G08B 5/22

[52] U.S. Cl. ..... 340/373; 340/366 R; 340/381; 340/378 R

[58] Field of Search ..... 340/373, 366, 381, 378 R

[56] References Cited

U.S. PATENT DOCUMENTS 3,704,462 11/1972 Pihl ..... 340/373

*Primary Examiner*—Harold I. Pitts

*Attorney, Agent, or Firm*—Pennie & Edmonds

[57] ABSTRACT

A binary indicator including a pair of indicator discs mounted along a common axis has means for damping rotational movement of a resetting structure in one direction following movement imparted to the resetting structure in the other direction for purposes of resetting the relative positions of the indicator discs to their relative positions prior to their relative relocation occasioned by a fault or malfunction condition. One indicator disc undergoes movement, the movement in both directions being induced magnetically. And, movement of the resetting structure in the other rotational direction is against the forces of rotational elasticity of spring means. A force for damping rotational movement of the resetting structure in the one rotational direction is developed by viscous-shear frictional engagement between a pair of friction discs biased into juxtaposition with a viscous film therebetween by the spring means under compression.

9 Claims, 15 Drawing Figures

DAMPING MEANS FOR INDICATORS

BACKGROUND OF THE INVENTION

The present invention relates to a form of indicator capable of binary indication of a fault or malfunction condition, for example, through movement of one of a pair of relatively movable indicator discs. The invention in particular relates to an electromagnetic indicator, many forms of which presently exist in the prior art.

One prior art form of electromagnetic indicator is the indicator disclosed in U.S. Pat. No. 3,704,462 which issued to George E. Pihl on Nov. 28, 1972. Reference may be had to the patent for full particulars as to its operation.

Briefly stated, however, the Pihl patent describes an electromagnetic indicator which is responsive to a condition as those above whereby one of a pair of cooperating indicator members, each of which is of disc-shape and mounted along a common axis, rotates relative to the other to change a visual display. Both of the indicator members have a plurality of sectors of like size; the sectors of the stationary indicator member being alternately transparent and opaque, while the sectors of the movable indicator member are totally opaque although alternately distinguishable. In the Pihl patent, it is described that the alternate sectors of the movable indicator are white and dark and that the opaque sectors of the stationary indicator member are dark, also. Pihl discusses that the dark sectors of both indicator members may be colored with a black paint. Thus, in one position, for example, the "set" position, of the movable indicator member its black sectors align with black sectors on the stationary indicator member and its white sectors align with transparent sectors, also on the stationary indicator member, and in the position to which the movable indicator member will have moved by virtue of a fault or malfunction condition the opposite alignment will be seen. An alignment of the sectors of the movable indicator member also may be employed such that in the "set" position its black sectors align with the transparent sectors of the stationary indicator member. For purposes of the present application, particularly in the discussion of the operation of the electromagnetic indicator, it will be assumed that in the "set" position of the indicator members the display will be totally black and that a fault or malfunction condition will be communicated displaywise by alternating black and white sectors.

Electromagnetic indicators, such as the electromagnetic indicator disclosed in the Pihl patent, while generally acceptable have been found to suffer from certain disadvantages. These relate principally to the manner of damping the return movement of the resetting structure which is actuated for returning the movable indicator member to the "set" position from which it shall have moved upon occasion of a fault or malfunction condition and the manner of proper tensioning of a spring which is provided to enable the return movement. In Pihl, resetting movement of the resetting structure is against the bias of a return spring and damping of the resetting structure is provided by a damping medium which acts to decelerate and prevent snap action return of the resetting structure driven by the return spring. The damping medium is a flowable viscous liquid, a volume of which is confined within the electromagnetic indicator in the space between the resetting structure and the stationary structure. The use of a viscous liquid has been found to create problems both of filling and front sealing of the electromagnetic indicator. And there are problems in the proper tensioning of the return spring which, at best, is accomplished through a trial and error procedure in the assembly of the electromagnetic indicator. Thus, the manner of tensioning of the return spring is by means of receipt of one end thereof in a slot carried by a component of the resetting structure of the electromagnetic indicator and by receipt of the other end in one of a plurality of slots carried by a component of the stationary structure of the electromagnetic indicator, thereby being dependent upon which of the slots receives the other end of the spring.

BRIEF DESCRIPTION OF THE PRESENT INVENTION

The present invention is an improvement over the electromagnetic indicator disclosed by Pihl in that the electromagnetic indicator of the present invention comprises a new spring arrangement and a new damping assembly. The spring arrangement includes a spring which is pre-stressed and both with relative ease and in a manner which obviates the heretofore required trial and error assembly may be received to cooperate with a new and unique form of damping assembly. To this end, the damping assembly of the electromagnetic indicator includes a pair of friction discs, one of which is prevented from rotational movement, while the other is capable of rotational movement with the resetting structure. The friction discs are positioned in opposed surface-to-surface relation and into contact with a viscous film therebetween. Both friction discs are subject continually to a constant axial force developed by the spring and damping of the resetting structure is by viscous-shear frictional engagement.

The manner of damping return movement of the resetting structure comprises a distinct improvement over the manner and means disclosed by Pihl. Thus, difficulties in filling the electromagnetic indicator with the viscous liquid, front sealing of the electromagnetic indicator to prevent leakage of the viscous liquid and of tensioning the return spring of the resetting structure are obviated.

There has thus been outlined rather broadly the more important features of the invention in order that the detailed description thereof that follows may be better understood and in order that the present contribution to the art may be better appreciated. There are, of course, additional features of the invention that will be described hereinafter and which will form the subject of the claims appended hereto. Those skilled in the art will appreciate that the conception upon which this disclosure is based may be readily utilized as a basis for the designing of other structures for carrying out the several purposes of the invention. It is important, therefore, that the claims be regarded as including such equivalent constructions as do not depart from the spirit and scope of the invention.

DESCRIPTION OF THE PREFERRED EMBODIMENT

The electromagnetic indicator, denoted by the numeral 10, and hereinafter the "indicator", is illustrated both in exploded fashion (FIG. 1) and in assembled fashion (FIGS. 2 and 3), while various of the operative components of the indicator may be seen in others of the figures.

Figure 1:
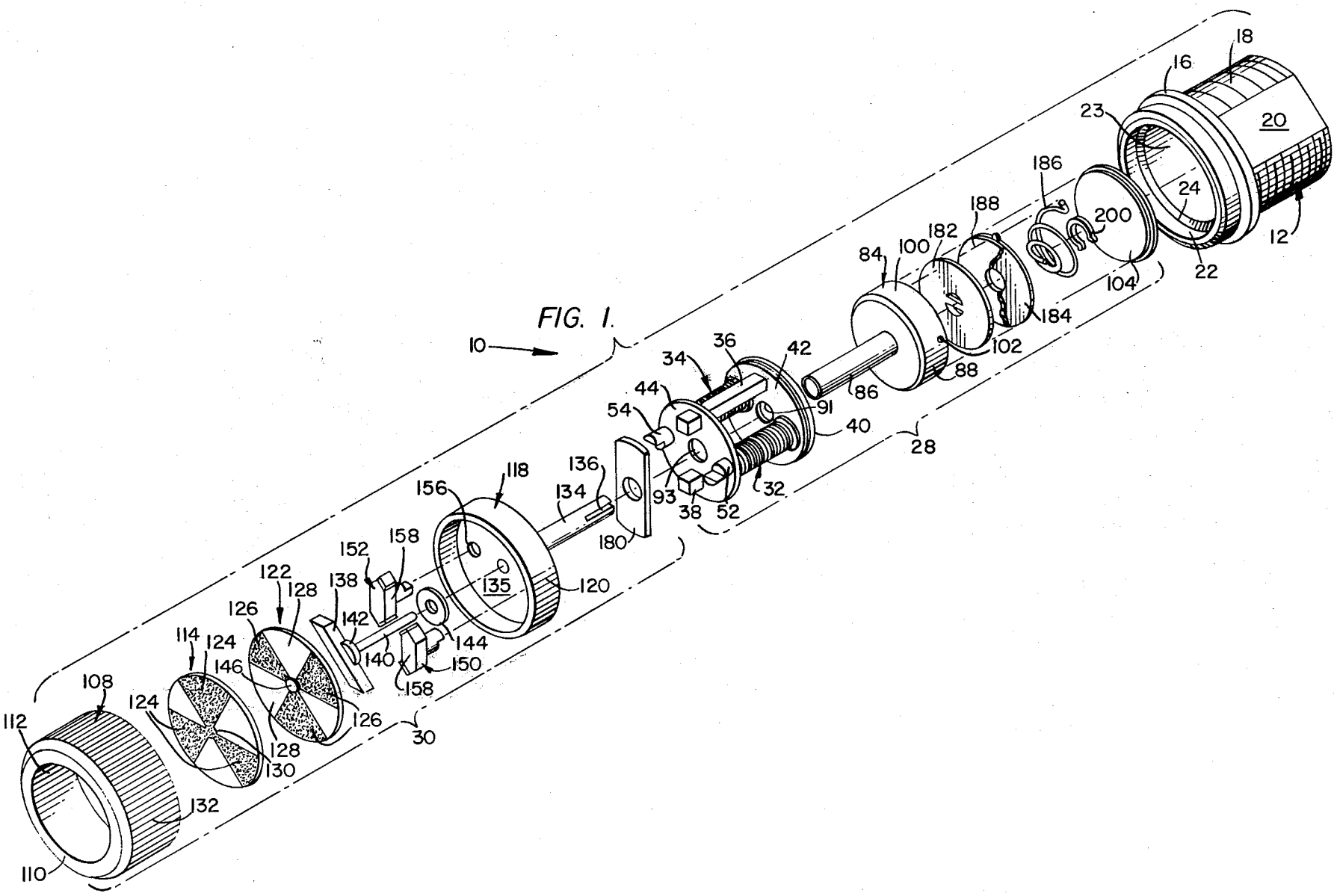
FIG. 1 is an exploded isometric view of the components of a preferred embodiment of electromagnetic indicator of the present invention.

With reference to FIG. 1, it will be appreciated that the indicator 10 includes a housing 12 which overall is of cylindrical outline and having an exterior flange 16 disposed near the front end. The housing below the flange is threaded therealong as at 18, the thread being interrupted by a land portion 20 which assures that the housing will be received in proper disposition by a panel (not shown) of an instrument whose fault or malfunction condition is to be monitored. The housing may be mounted on and secured to the panel in any manner such as by a lock nut (not shown) threadedly received behind thereby to draw the flange toward the panel.

Figure 2:
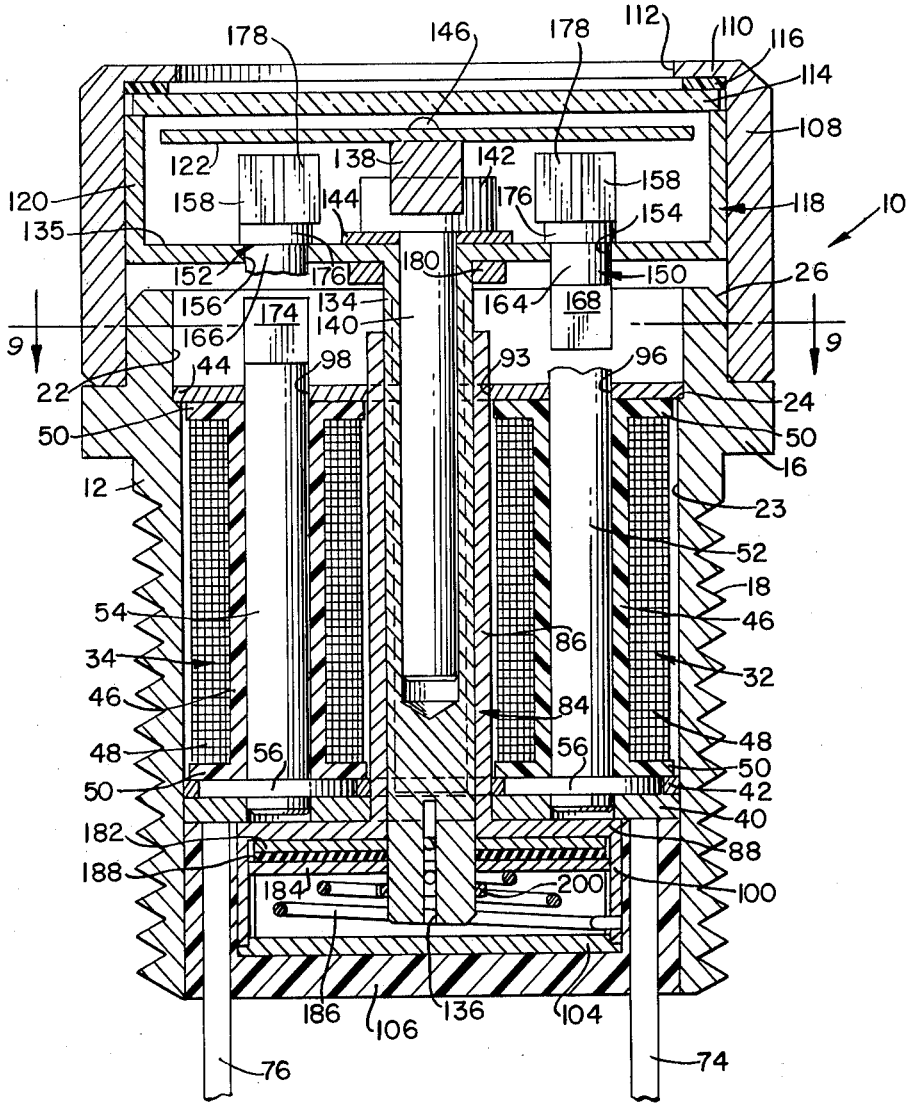
FIG. 2 is an enlarged view in vertical section of the structural components of FIG. 1 in assembled condition.
Figure 3:
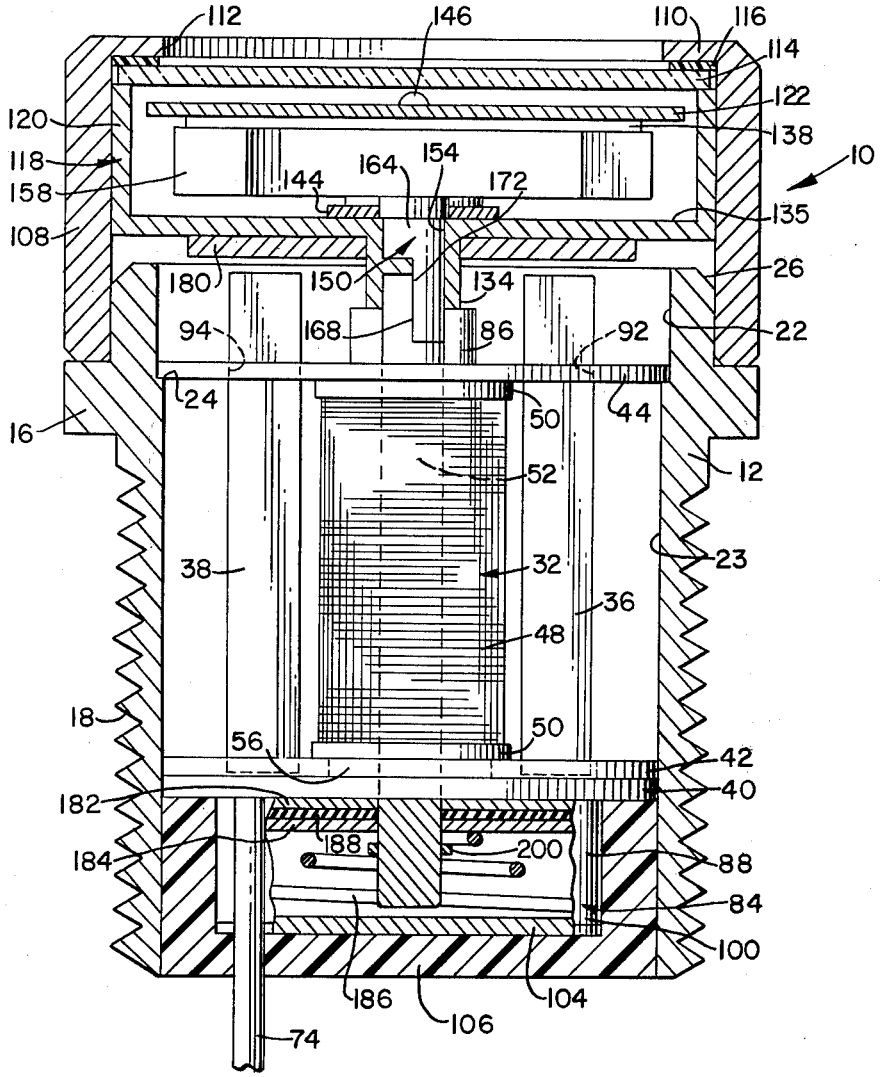
FIG. 3 is a side elevation, partially in section, of the structural components of FIG. 2 yet rotated through an angle of 90°.

As best seen in FIGS. 2 and 3, the interior of the housing 12 is formed by a pair of concentric cylindrical surfaces 22, 23 connected by a shoulder 24. The front end of the housing may be beveled outwardly as at 26 to facilitate mounting of the knob assembly of the indicator, as hereinafter described.

For reasons as will become apparent, the housing 12 preferably is fabricated of a non-magnetic metal or of one of the commonly used plastics having the characteristics of strength, rigidity, and impact strength among others as would be apparent for use as a support for structure.

A base assembly including those components within the brace 28 is received within the housing, and a knob assembly including those components within the brace 30 is received partially within the housing and partially on the housing over the bevel at the front end. The base assembly comprises generally the stationary portion of the indicator, while the knob assembly comprises generally the movable portion of the indicator. The particulars of these assemblies now will be brought out.

The base assembly, as illustrated in FIGS. 1-3, includes a pair of electromagnets 32 and 34 and a pair of permanent magnets 36 and 38 (hereinafter "reset magnets") arranged in quadrature and at substantially equal radii. Both pairs of magnetic structure are supported by a core return member 40 (hereinafter "core return") and printed circuit tabbing board 42 (hereinafter "tabbing board") at one end and a disc 44 near their other end.

Each of the electromagnets includes a bobbin 46 fabricated of an insulating material, for example, plastic. A coil 48 is wound throughout a number of turns on each of the bobbins within a region bounded at opposed ends by flanges 50. The number of turns and the gauge of the wire will be determined by factors, such as the power of the source of the input, the desired resistance and other operational factors all as are well known. A core member 52 is disposed within the central hollow of bobbin of electromagnet 32 and a similar core member 54 is disposed within the central hollow of bobbin of electromagnet 34. Each of the core members includes a flange 56 adjacent one end. The flange 56 engages between an outer surface of the bobbin at one end and the core return 40 (see FIGS. 2 and 3).

Figure 4:
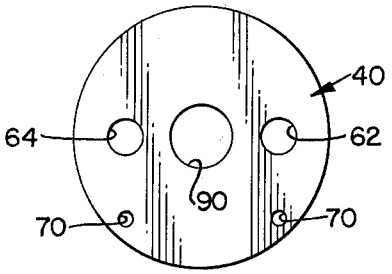
FIG. 4 is a plan view, reduced in size, of a core return member of the present invention.
Figure 5:
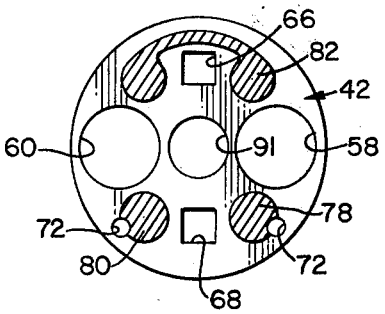
FIG. 5 is a plan view, reduced in size, of a printed circuit tabbing board of the present invention.

As may be seen in FIGS. 1, 4 and 5, the core return 40 and tabbing board 42 are of disc-shape, and in assembled relation reside in juxtaposed fashion to support both pairs of magnetic structure. With particular reference being directed to the latter figures, the tabbing board 42 includes a pair of cutouts 58 and 60 which are of an outline complementary to the outline of the flange 56 of each of the core members 52 and 54 received therethrough. The core return 40 similarly includes a pair of cutouts 62 and 64. The axis of each cooperating pair of cutouts 58, 62 and 60, 64 is located on a common diameter and at equal radii. The cutouts 62 and 64 are smaller in size to accommodate the ends of the core members 52 and 54, both of which terminate at a plane between opposed surfaces of the core return. The tabbing board 42 includes a second pair of cutouts 66 and 68 located substantially at equal radii although substantially at angles of 90° from the axes of cutouts 58 and 60. The cutouts 66 and 68 are of an outline complementary to the outline of reset magnets 36 and 38. The magnetic structures may be of any outline or configuration as best for the operation desired. Thus, for example, in the embodiment illustrated, the cutouts 66 and 68 are rectangular to accommodate the ends of reset magnets 36 and 38, respectively. As seen in FIG. 3, one end of the reset magnets is supported on the surface of core return 40 in a manner similar to the support of the flange 56 of core members 52 and 54.

The core return 40 is formed of soft iron or other highly permeable material and tabbing board 42 is formed of an insulating material which may be plastic.

With continued reference to FIGS. 4 and 5, the core return 40 and tabbing board 42 include two pairs of openings 70 and 72, respectively. These openings are coaxially disposed and when the discs are in juxtaposition the ends of terminal leads 74 and 76 may be received therethrough. The openings 72 are formed adjacent a pair of lands 78 and 80, each of which is provided with a conductive coating, such as copper. A land 82 similarly provided with a conductive coating, which may be copper, is spaced from the former lands. The land 82 may be of the shape of a dumbbell, as seen in FIG. 5. The coils 48 of the electromagnets 32 and 34 are arranged in series (see FIG. 8) through attachment of one end of each coil to the remote portions of land 82 while the other end of each coil is attached to respective ones of lands 78 and 80.

Returning again to FIG. 1, the base assembly additionally includes a member 84 including a sleeve 86 whose interior communicates with a housing 88. The member 84, also, is formed of a non-magnetic material, such as a plastic and preferably a rigid plastic to support damping structure to be discussed below.

The sleeve 86 is of a length to extend through a pair of openings 90 and 91 formed along the central axis of the core return 40 and tabbing board 42, respectively (see FIGS. 4 and 5), as well as through and slightly beyond an opening 93 in disc 44 (see FIG. 2). The inner diameter of the openings and the outer diameter of the sleeve 86 are chosen so that a snug fit is provided.

The disc 44 additionally includes a further set of openings 92, 94 and 96, 98 (see FIGS. 2 and 3) to accommodate, respectively, the other end of reset magnets 36 and 38 and the other end of core members 52 and 54. This end of each of the reset magnets and core members extends beyond the end of sleeve 86 of member 84, yet terminates within the confines of case 12 when the base assembly is received, fully.

Figure 11:
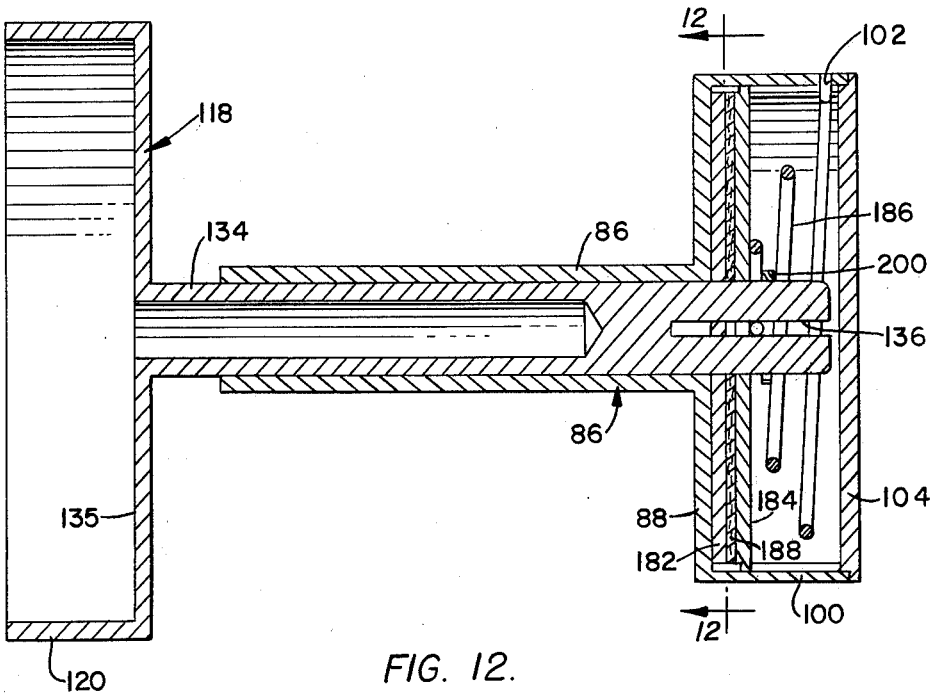
FIG. 11 is a partial assembly of the structural components of FIG. 1 illustrating the spring arrangement and damping assembly.
Figure 12:
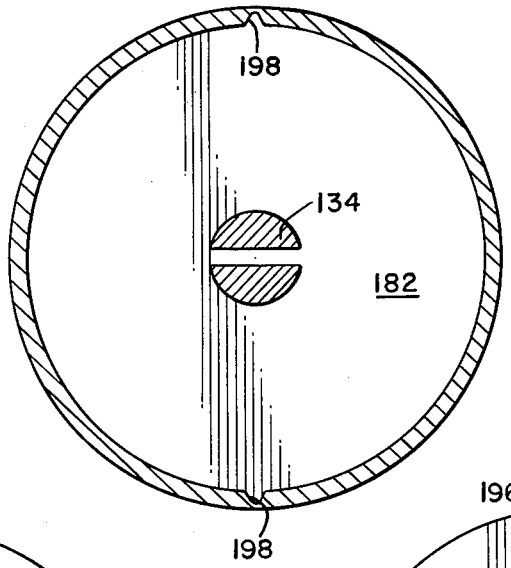
FIG. 12 is a sectional view as seen along the line 12—12 in FIG. 11.
Figure 13:
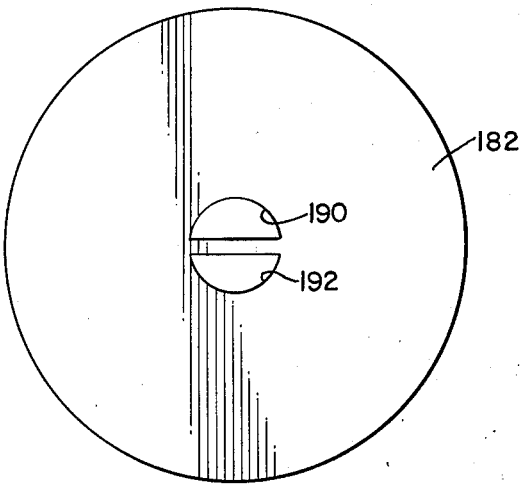
FIG. 13 is a plan view of a movable friction disc.

As best illustrated in FIG. 11 the housing 88 of member 84 is cup-shaped in outline including a cylindrical wall or skirt 100 wherein, for reasons as will be set out below, there is an opening 102. The housing in assembly will be closed by a cover 104 secured at the base of the skirt 100 in any convenient manner. An adhesive or suitable fasteners as are well known in the art may be employed for this purpose. In assembly, member 84 is received in the base assembly such that the upper spanning surface of housing 88 is in juxtaposition to the lower surface of core return 40 (FIGS. 2 and 3). Thereafter a potting material 106 may be received around the skirt 100 of housing 88 and over cover 104 thereby to hermetically seal the lower end of case 12. The disc 44 serves to close the other end of case 12. To this end, the inner diameter of the cylindrical surfaces 22 and the outer diameter of the disc 44 are such that there is a tight frictional engagement at shoulder 24. However, the indicator, at the upper end of the case 12, may be sealed in a more permanent manner by potting material (not shown) received at the outer periphery of disc 44, as well as around the openings 92 . . . and 98 in disc 44 for reset magnets 36 and 38, core members 52 and 54 and sleeve 86.

The knob assembly comprising the movable portion of the indicator, now will be described. Referring to FIG. 1, the knob assembly includes a knob 108 having a cylindrical body and a flange 110 at one end. The flange extends inwardly to define the outline of an opening 112 which provides a viewing window. An indicator disc 114 comprising one of a pair of flag members of the indicator 10 is received stationarily behind the viewing window. To this end, reference now being directed to FIGS. 2 and 3, the indicator disc 114 (hereinafter "stationary flag") is received juxtaposed to a resilient gasket 116 of annular outline disposed behind the flange to provide a cushion support for the stationary flag thereafter immobilized in movement relative to the knob by a bearing cup 118 received by a frictional fit within the knob 108. Particularly, the bearing cup is received to a position such that a rim of skirt 120 coacts with the other surface of the stationary flag.

An indicator disc 122 comprising the second of the pair of flag members of the indicator 10 is adapted to cooperate with the stationary flag 114 as will be more particularly described below thereby through visual observance to indicate a fault or malfunction condition on the one hand and a normal condition on the other hand. As described, the display will depend upon the rotational position of indicator disc 122 (hereinafter "movable flag") relative to the stationary flag 114.

Figure 6:
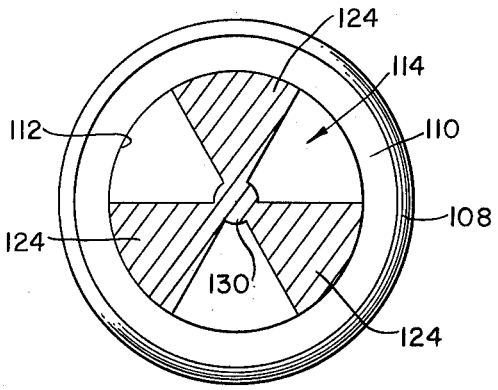
FIG. 6 is a front end view, reduced in size of the reset ring of the electromagnetic indicator including one of the indicator members.
Figure 7:
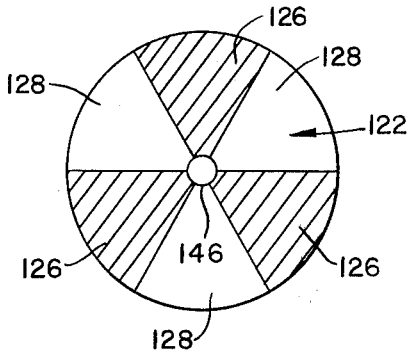
FIG. 7 is a plan view, reduced in size, of a second of the indicator members.

As illustrated in FIGS. 1, 6 and 7, the stationary and movable flags 114 and 122, respectively, are provided with a first plurality of sectors 124 and 126, respectively, spaced apart by a second plurality of sectors of a size substantially equal to the size of the first plurality. The stationary flag 114 preferably is formed of a transparent material and the sectors 124 are coated with a dark, for example, black paint. The movable flag 122 may be formed similarly or of any material which may be opaque. The sectors 126, however, will be like the sectors 124 and the intervening sectors 128 will contrast therewith. Thus, sectors 128 may be coated, for example, with white paint. The sectors 124 of the stationary flag 114 merge into and form an area 130 concentric with the axis of the stationary flag which obscures the area at the apices of the sectors of the movable flag.

The outer surface of knob 108 is serrated at 132 to enhance grippability of the knob in resetting of the movable flag 122 from the position to which it shall have moved upon a fault or malfunction to the "set" position, as will be discussed hereinafter.

The bearing cup 118 includes a shaft 134 which extends from a base surface 135 connecting with skirt 120. The shaft is hollow throughout at least a substantial portion of its length from the base surface (see FIG. 11) and a slot 136 is cut or otherwise formed at its end. The slot is disposed across a diameter and is of a width and depth for purposes also set out below.

The skirt 120 of the bearing cup 118 provides a chamber within which the movable flag 122 is free to rotate upon occasion of a fault or malfunction condition of the instrument being monitored, and by this rotation relative to stationary flag 114 provide one of the binary indications of a fault or malfunction condition on one hand and a normal condition on the other hand.

The movable flag 122 is made fast to a bar magnet 138 which, in turn, is supported by a shaft 140 through an interposed hub 142. Any particular manner of attachment may be resorted to. A washer 144 is received loosely on the shaft 140. The washer acts as a bearing between the base surface 135 and hub when the shaft is received into the hollow length of shaft 134.

The movable flag 122 is provided with an axial protuberance 146 which extends toward the inner surface of stationary flag 114. The protuberance serves as a thrust bearing thereby to prevent substantially axial movement of shaft 140 relative to the bearing cup 118.

A pair of stop members 150 and 152 are supported by bearing cup 118 within a pair of openings 154 and 156 (see FIG. 2) in the base surface 135. The axes of the openings are disposed along a diameter and at equal radii from the axis of shaft 134. The axes of the openings, further, in the normal position of the bearing cup 118, are coaxial with the axes of core members 52 and 54, respectively. The stop members each include an upper generally rectangular body 158 (see FIGS. 10A and 10B) having ends which taper symmetrically toward their respective major axes. The tapered surfaces are denoted by the numerals 160 and 162. The stop members 150 and 152 each include, further, a pin portion 164 and 166, respectively. The pin portions extend through individual ones of the openings 154 and 156 thereby to engage with extensions of the core members 52 and 54, respectively, in the normal position of the bearing cup 118 and with the ends of reset magnets 36 and 38, respectively, in the position to which the bearing cup 118 is moved to reset the movable flag. This will be further described when considering FIGS. 10A and 10B. As may be seen to advantage in FIGS. 1–3, the pin portions are cylindrical in cross section with a half section removed within the region of the end to provide a flat face. Thus, pin portion 164 includes a flat face 168 and pin portion 166 includes a flat face 170. The extensions of core members 52 and 54 are similarly formed to provide flat faces 172 and 174, respectively.

The stop members 150 and 152 are anchored such that their major axes are at all times parallel. A stop section 176 is formed on each pin portion near the body 158 (see FIG. 2). The stop section comprises a length of greater diameter and serves to maintain a slight spacing between the body 158 and the base surface 135 of bearing cup 118 thereby to position the body in the path of movement of bar magnet 138. Additionally, the stop members are anchored so that the flat faces 168 and 170 are oppositely disposed. The flat faces 172 and 174 formed in the extensions of core members 52 and 54 also are oppositely disposed thereby to cooperate with the former flat faces with a lap connection.

The stop members 150 and 152 are formed of a magnetic material such as soft iron, steel or any other highly permeable magnetic alloy. The core members 52 and 54 preferably are formed of similar material. As has been described, the pin portions 164 and 166 when the bearing cup 118 is in one rotational position, i.e., the normal position or "set" position, engage and form an extension of core members 52 and 54, and when the bearing cup 118 is moved to a second rotational position to reset the movable flag the pin portions 164 and 166 engage and form extensions of the reset magnets 36 and 38.

The bar magnet 138 is parallelepiped in outline and has freedom of movement rotationally within limits defined by the positioning of stop members 150 and 152. The limit of movement of the bar magnet 138 in one direction of rotation is defined by the tapered surfaces 160, while in the other direction of rotation it is defined by the tapered surfaces 162. A stop pad 178 prevents the bar magnet 138 from a direct surface-to-surface contact with the respective tapered surfaces 160 and 162. The stop pad 178 is formed of a non-magnetic material or may be in the form of a coating such as TEFLON or the equivalent having a low coefficient of friction for non-sticking engagement and for spacing. Preferably the stop pad will be supported on the tapered surfaces 160 and 162. TEFLON has proved satisfactory.

A shunt member 180 (see FIGS. 10A and 10B) in the form of an elongated, flat, plate is received immovably around the shaft 134 of bearing cup 118. As illustrated, the shunt member is disposed adjacent the lower surface of the bearing cup and because of the nature of its receipt on the shaft it will move with and remain in position such that its longitudinal axis is in alignment with the major axes of stop members 150 and 152 although, depending upon the position of the knob assembly, it will be disposed so that its longitudinal axis is substantially coincident with an imaginary line connecting either the reset magnets 36 and 38 or the core members 52 and 54. The shunt member is of a length to traverse at least the distance between an extension of the axes of each pair of magnetic structures. The shunt member 180 may be formed of a magnetic material such as stainless steel (type 430).

The shaft 134 of bearing cup 118 is received within the sleeve 86 of member 84 to a position such that the slot 136 is within the area bounded by skirt 100. By virtue of the slot 136 the solid end of shaft 134 defines a pair of back-to-back D-shaped sections.

The damping structure, which may be seen best in FIGS. 1 and 11, comprises first and second discs 182 and 184, and a spring 186 having a dual function of providing a bias force upon the discs to move them longitudinally toward the inner surface of member 84 and an elastic force to maintain the knob assembly in the normal position or to return it to the normal position after resetting the indicator 10 as will be discussed. The damping structure also includes a film of a viscous, high shear force material 188 which may be a film of silicone grease carried by one or the other of the opposing surfaces of discs 182 and 184. The film for all intents and purposes acts as a third disc between the other two.

Figure 14:
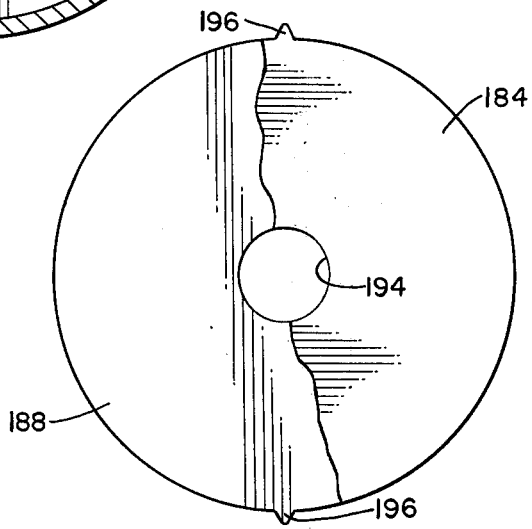
FIG. 14 is a plan view of a stationary friction disc.

The disc 182 is formed with a pair of openings 190, 192 which are complementary in outline to the D-shaped sections whereby the disc may be received over the end of shaft 134. The slot is of a length such that the disc 182, under the biasing force of spring 186, is received in surface-to-surface contact with the inside surface of the cup-shaped housing 88 of member 84 and by virtue of the cooperating openings and sections, the disc 182 follows in movement rotational movement of the bearing cup. The disc 184 is somewhat similar in make-up to that of disc 182 and likewise is received over the end of shaft 134. However, disc 184 has a cylindrical opening 194, the inner diameter of which is sufficiently larger than the diameter of shaft 134 to prevent substantially any frictional couple of the disc and shaft. Disc 184, however, will at all times be fixed in movement rotationally. To this end, according to the present embodiment, at least one and preferably a pair of ears 196 are formed on disc 184 and a like number of slots 198 are formed internally of the skirt 100, the ears being received into the slots when the disc 184 is mounted. The film of silicone grease 188 is received on the surface of disc 184 as seen in FIGS. 1 and 14 through the cut-away and illustrated in FIG. 11 in slightly exaggerated dimension. The film of silicone grease provides an important aspect of the invention whereby damping of return movement of the resetting structure is carried out by viscous-shear frictional engagement between the discs 182 and 184.

A ring 200 such as a Waldes Truarc ring, well known to persons skilled in the art, is received on the shaft 134 and positioned adjacent the disc 184. The ring is capable of providing a friction grip with the shaft that is sufficiently strong that it will not slip on the shaft 134 and prevents axial movement of the shaft out of sleeve 86. The ring 200 is orientated such that its opening is disposed along the longitudinal axis of the slot 136 to accommodate the receipt of spring 186, one end of which is disposed in the slot. The second end of the spring is disposed through the opening 102 in the skirt 100 of member 84. As previously stated the end of skirt 100, after assembly is completed, is closed by a cover 104. The cover will provide a support surface for the body of spring 186. Summarizing, the arrangement of and manner of mounting each disc results in disc 182 rotating conjointly with shaft 134 and disc 184 being immobilized by member 84. Both discs are formed of a material having high frictional characteristics which together with the silicone grease film develop the viscous-shear frictional force through which superior damping action is obtained.

Spring 186 is pre-stressed and serves the purpose of returning the knob assembly to a normal position following setting of the movable flag 122, of providing a constant axial bias force on the discs 182 and 184 so that through the surface-to-grease-to-surface contact the return movement of the knob assembly is dampened, and of exerting an outward force on the knob assembly thereby to assure that damping is carried out in the area of the discs and not within the area of the knob assembly.

Figure 8:
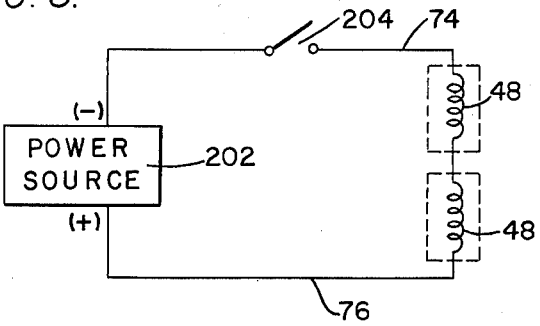
FIG. 8 is a schematic illustration of an operating circuit to which the electromagnetic indicator may be connected.

FIG. 8 illustrates a possible circuit arrangement whereby the coils 48 of electromagnets 32 and 34 are connected in series and to a power source 202, such as a battery, through a switch 204.

Figure 10B:
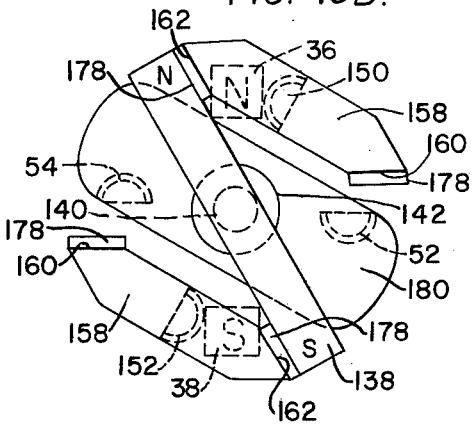
FIGS. 10A and 10B are schematic top plan views illustrating the resetting structure in the normal position and in the position to which it is rotated, respectively, to return the indicator members to the "set" position.
Figure 9:
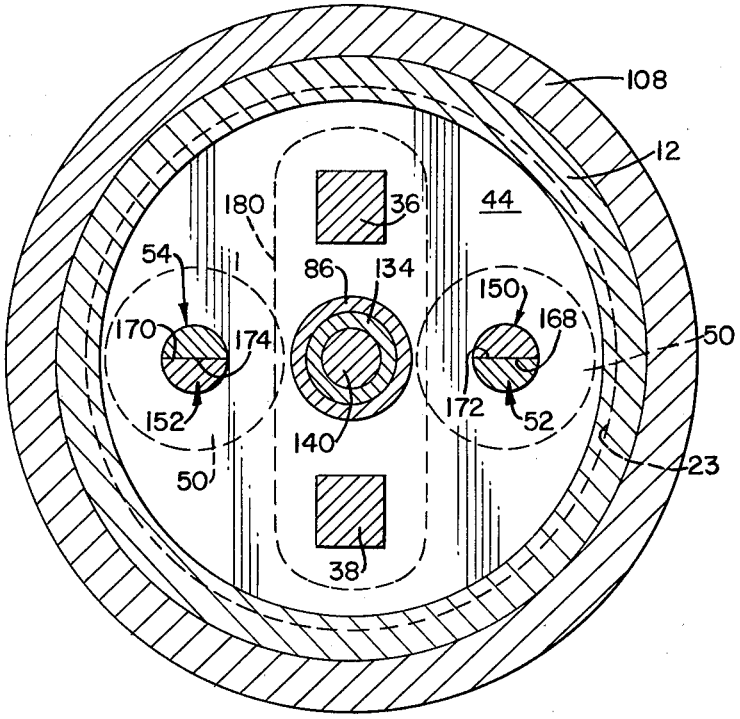
FIG. 9 is a sectional view as seen along the line 9—9 in FIG. 2.
Figure 10A:
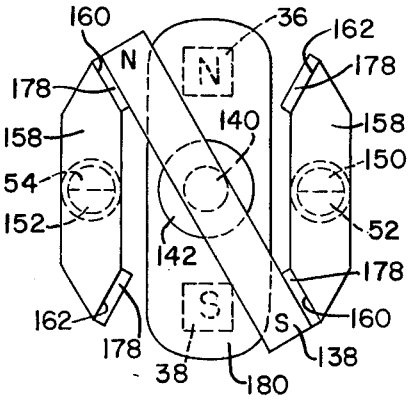

The operation of the indicator 10 now will be described. Initially, referring to FIGS. 9, 10A and 10B, the positioning of the knob assembly, determined by the elastic action of spring 186, is such that the flat faces 168 and 170 of the pin portions 164 and 166 of stop members 150 and 152 engage the flat faces 172 and 174 of cores 52 and 54 of electromagnets 32 and 34, respectively. Assuming that the magnetic polarity of each of reset magnets 36 and 38 and bar magnet 138 are as illustrated in FIGS. 10A and 10B and that FIG. 10A represents the "set" position of stop members 150 and 152, bar magnet 138 will be in engagement with oppositely disposed tapered surfaces 160 of the stop members 150 and 152 and the shunt member 180 will extend over the ends of reset magnets 36 and 38. The movable flag 122 will be secured to the bar magnet so that its black sectors 126 are in alignment with the transparent sectors of the stationary flag 114. Thus, the indicator 10, assuming this criteria, provides an indication at the viewing window 112 which is totally black opaque. If the terminal leads 74 and 76 of the indicator are coupled to the source of power 202, as discussed above, and switch 204 is closed momentarily to provide a current pulse through the series connected coils 48 the coils which are oppositely wound will generate opposite poled magnetic fields. If the bar magnet 138 is in the position of FIG. 10A such that its north (N) pole engages stop member 152 and its south (S) pole engages stop member 150, the current applied to the two coils 48 must be such that the upper end of core 52 becomes a south (S) pole and the corresponding end of core 54 becomes a north (N) pole. The stop members will be similarly polarized and as a result the bar magnet 138 will be repelled from the tapered surfaces 160 and rotate in a clockwise direction to the other limit position whereby the bar magnet will be in a position of engagement with tapered surfaces 162 of stop members 150 and 152. The movable flag 122 moves through a similar rotational angle to change the display. The magnetic flux between bar magnet 138 and the tapered surfaces 160 of stop members 150 and 152 diminishes as the distance therebetween increases so that at some point in this clockwise travel the bar magnet will be influenced primarily by the attractive influence of the magnetic flux at the tapered surfaces 162 of the stop members. In this connection the current pulse, indicative of a fault or malfunction, need last just long enough to assure that the bar magnet 138 will reach and pass beyond the point where the attractive influence of the flux at the tapered surfaces to which the bar magnet is approaching together with the inertia of the bar magnet is strong enough to cause the bar magnet to continue to the other limit position. Prior to application of this current pulse, the bar magnet 138 is magnetically latched to the first-named tapered surfaces and after the application of the current pulse the bar magnet will similarly be latched to the last-named tapered surfaces of the stop members.

The change in position of bar magnet 138 and movable flag 122 causes the sectors 128 of the movable flag 122 to relocate to a position of alignment with the transparent sectors of the stationary flag 114 providing an indication at the viewing window 112 which, as described, is alternately black and white. The movable flag will remain in this position of orientation indicative of the occurrence of a fault or malfunction condition until reset by the resetting of knob assembly.

To reset the indicator 10, the knob assembly is rotated from the FIG. 10A orientation counterclockwise as in FIG. 10B to a position at which the pin portions 164 and 166 of stop members 150 and 152 are in engagement with the ends of reset magnets 36 and 38, respectively. The bar magnet 138 will move with the latter. The poles of the reset magnets 36 and 38 are disposed such that pin portion 164 engages a north (N) pole and pin portion 166 engages a south (S) pole. When this occurs, the stop member 150 becomes a north (N) pole extension of reset magnet 36, while the other stop member 152 becomes a south (S) pole extension of reset magnet 38. The result is that the bar magnet 138 is immediately repelled from the tapered surfaces 162 of stop members 150 and 152 and rotates further in the counterclockwise direction in return to its initial position of engagement with the tapered surfaces 160. In line with the discussion of the time duration of the current pulse, the knob assembly should be held in the counterclockwise limit until the magnet shall have completed its further counterclockwise movement. When the knob assembly, which is moved against the elastic forces of spring 186, is released, it will immediately rotate in the clockwise direction to its original "set" position at which the flat faces 168 and 170 of the stop members 150 and 152 again engage the flat faces 172 and 174 of core members 52 and 54. The discs 182 and 184 and the material 188 provide a damping of movement of the knob assembly.

The bar magnet 138 again, moves with the stop members 150 and 152 in return of the knob assembly to the "set" position (FIG. 10A) at which the sectors 126 of movable flag 122 will again find themselves in alignment with the transparent sectors of the stationary flag 114. The visual indication in the "set" position also may be alternately black and white.

The shunt member 180 serves to limit the magnetic influence of reset magnets 36 and 38 on the bar magnet 138 when the bar magnet is undergoing the aforediscussed excursions. Thus, the shunt member serves to provide a low recluctance path for the magnetic flux of reset magnets 36 and 38 so as not to disturb operation of the bar magnet by energization of the coils 48 of electromagnets 32 and 34 (since the shunt member 180 moves with the bearing cup 118 from a position over the reset magnets 36 and 38 when the knob assembly is rotated to reset the movable flag).

Rather than a manual reset, the movable flag of indicator 10 may be reset electrically by energizing the coils 48 of electromagnets 32 and 34 with a current pulse of opposite polarity. As should be appreciated the source of power which has been described as a battery must be arranged in the circuit such that pulses of opposite polarity will be provided to the terminals 74 and 76. Thus, switch 204 may be replaced by a switch capable of reversing the connections to the power source 202.

The indicator of the present invention is characterized by fast response, one requiring low input power, is relatively insensitive to shock, vibration or orientation of the casing 12 in the supporting panel (not shown) and by provision of black and white opaque sectors on the relatively movable flag 122 it is relatively easy to discern under any condition of ambient light whether there has been a fault or malfunction of the device which is being monitored. Further, and as an important aspect of the invention the indicator of the present invention provides a unique arrangement of discs and a silicone film thereby through the agency of a single spring to provide an action of damping movement by frictional shear of structures in return under spring forces to the normal position.

Having described the invention with particular reference to the preferred form thereof, it will be obvious to those skilled in the art to which the invention pertains after understanding the invention, that various changes and modifications may be made therein without departing from the spirit and scope of the invention as defined by the claims appended hereto.

What is claimed is:

1. In a binary indicator for indicating one of a normal condition and a fault or malfunction condition of apparatus being monitored comprising a casing, an indicator assembly received by said casing and including an indicator disc, means mounting said indicator disc for movement about the axis of said casing in opposite rotational directions through less than a full turn between two stable positions, means in said casing responsive to a change of at least momentary duration from said normal condition, means cooperating both with said condition responsive means and mounting means to impart rotational impetus to said indicator disc whereby said indicator disc relocates from one to the other of said stable positions upon occurrence of said change, means for resetting said indicator disc to the former of said stable positions so that said indicator disc may similarly relocate to the latter position upon a subsequent change in condition, said resetting means being carried by said casing and adapted to be rotated from a first limit position, said resetting means including means for imparting rotational impetus to said indicator disc to return to said former position when said resetting means shall have been rotated to a second limit position, means biasing said resetting means toward said first limit position, damping means for damping movement of said resetting means in return to said first limit position under forces of said biasing means, said damping means including at least a pair of friction discs and a layer of a high shear force material therebetween in surface-to-surface contact with the discs of each pair, and window means for viewing a display definitive of said condition on said indicator disc, said window means being carried by said resetting means and coaxial with said indicator disc.

2. The indicator of claim 1 wherein said biasing means includes a spring, one end of said spring connected to said casing and the other end connected to said resetting means, and said spring also acting axially to bias said friction discs into said surface-to-surface contact.

3. The indicator of claim 1 wherein said resetting means includes knob means received telescopically at one end of said casing for relative rotation, means supported by for conjoint movement with said knob means having a mounting surface disposed substantially parallel to said indicator disc and an elongated portion depending from said surface coaxially of said casing.

4. The indicator of claim 3 including a cup-shaped member whose housing is open away from said indicator disc, said member being supported stationarily in said casing and including an opening, said elongated portion extending through said opening and terminating therein.

5. The indicator of claim 4 wherein said friction discs are received about said elongated portion, one of said friction discs being rotatable with said elongated portion, and means for restraining the other of said friction discs.

6. The indicator of claim 5 wherein said biasing means includes a spring, said elongated portion including means at one end for receiving one end of said spring, said other end of said spring being received by said cup-shaped housing, and a cover for closing said cup-shaped housing, said cover providing a surface against which said spring may act whereby said discs are biased axially.

7. The indicator of claim 1 wherein said layer of high shear force material is a viscous silicone grease, said silicone grease comprising a surface coat on one of said friction discs of each pair.

8. An indicator capable of providing binary indication either of a fault or malfunction condition or a normal condition comprising a casing, first and second indicator discs supported in coaxial spaced relation at one end of said casing and at least said first disc adapted for rotation in opposite directions whereby said discs when said first disc is in a first of two bistable dispositions indicate one of said conditions and said discs when said first disc is in the second bistable disposition indicate the other of said conditions, electromagnetic means including at least one electromagnet having a core and a winding therearound, means adapted for connecting said winding to a source of current whereby said core may be alternately polarized, a first permanent magnet, means immovably supporting each said electromagnetic means and said permanent magnet in said casing so that an end of said core and said permanent magnet are directed axially and extend coextensively toward said discs, a second permanent magnet, means supporting said second permanent magnet for rotation induced by magnetic repulsion about said axis between two limit positions, said second magnet disposed so that its polar axis is substantially normal to said axis of rotation, said first disc supported by said second magnet and movable conjointly with said second magnet between said limit positions which define said first and second bistable dispositions, respectively, means for resetting said first disc following movement from said first bistable disposition, said resetting means including flux permeable means capable of mechanical engagement with thereby to form an extension of said core and said first magnet whereby it is magnetized in accordance with the magnetic field of said core and first magnet, said extensions disposed in the path of movement of said second magnet for magnetically latching said second magnet in a particular one of said bistable positions, spring means biasing said resetting means in one rotational direction, said resetting means movable relative to said casing against said spring bias whereby said first disc and second magnet follows said movement until said second magnet is repulsed when said extension is oppositely magnetized thereby to cause said first disc and second magnet to move in the opposite direction in return to said first bistable disposition, and damping means for damping movement of said resetting means in the other rotational direction under forces imparted by said spring means, said damping means including a pair of friction discs and a layer of a high shear force material therebetween biased into surface-to-surface contact by said spring means.

9. A binary indicator apparatus capable of providing an indication representative on the one hand of a normal condition and on the other hand of a fault or malfunction condition of equipment being monitored comprising a casing; an indicator assembly including a first indicator disc, and means supporting said first disc for movement in opposite rotational directions about the axis of said casing between two bistable positions, one said bistable position being a "reset" position and the other said bistable position being a "set" position; electromagnetic means immovably supported in said casing, said electromagnetic means including at least one electromagnet having an elongated core disposed axially of said casing, a winding around said core and means adapted for connecting said winding to a source of current for polarizing said core as determined by the direction of current flow; a reset assembly including a second indicator disc of outline similar to that of said first disc and having at least one transparent area for viewing a display on said first disc; means supporting said second disc in spaced coaxial relation to said first disc whereby said display distinguishing either of said bistable positions may be viewed, said second disc supporting means being received by said casing and adapted for movement relative to said casing, also in opposite directions between a first and second limit position, first permanent magnet means, means supporting said first magnet immovably in said casing with its polar axis disposed substantially parallel to said axis of said casing with the end toward said first disc being coextensive with said core, and flux permeable means carried by and movable with said second disc supporting means, said flux permeable means defined by a member, one for each said core and first magnet means, and depending upon the disposition of said second disc supporting means at said first or second limit position providing an extension of one or the other of said core and first magnet means; said means supporting said first disc including a second permanent magnet disposed so that its polar axis is normal to said axis, said members providing first a stop for movement of said second magnet and second a stop for movement of said reset assembly whereby said members at said limits act to latch said second magnet or magnetically repulse the same; means for biasing said reset assembly to one of said limit positions; and damping means including at least a pair of discs having facing surfaces with a layer of a high shear force material therebetween for developing a frictional resistance to movement when in surface-to-surface contact with said material under forces developed by said biasing means.

* * * * *